US011725473B2

(12) United States Patent
Aleid

(10) Patent No.: US 11,725,473 B2
(45) Date of Patent: Aug. 15, 2023

(54) SYSTEM AND METHOD FOR PROTECTING A PACKER DURING DEPLOYMENT

(71) Applicant: Saudi Arabian Oil Company, Dhahran (SA)

(72) Inventor: Abdulrahman K. Aleid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/646,801

(22) Filed: Jan. 3, 2022

(65) Prior Publication Data

US 2023/0212924 A1 Jul. 6, 2023

(51) Int. Cl.
*E21B 33/127* (2006.01)
*E21B 33/12* (2006.01)

(52) U.S. Cl.
CPC ..... *E21B 33/127* (2013.01); *E21B 33/12* (2013.01); *E21B 33/1208* (2013.01)

(58) Field of Classification Search
CPC ..... E21B 33/12; E21B 33/127; E21B 33/1208
See application file for complete search history.

(56) References Cited

U.S. PATENT DOCUMENTS

| | | | |
|---|---|---|---|
| 3,196,949 A | 7/1965 | Thomas | |
| 3,645,335 A | 2/1972 | Current | |
| 5,197,542 A | 3/1993 | Coone | |
| 5,361,836 A | 11/1994 | Sorem et al. | |
| RE36,880 E | 9/2000 | Pringle | |
| 7,552,767 B2 | 6/2009 | Wood | |
| 8,051,914 B2 | 11/2011 | Freyer | |
| 8,689,894 B2 | 4/2014 | Regnault de la Mothe et al. | |
| 8,763,688 B2 * | 7/2014 | Webb, Jr. | E21B 33/127 166/80.1 |

(Continued)

FOREIGN PATENT DOCUMENTS

| | | |
|---|---|---|
| CN | 204827335 U | 12/2015 |
| RU | 2455453 C2 | 7/2012 |

OTHER PUBLICATIONS

Solinst, Permanent Packers, Engineered Seal, https://www.solinst.com/products/multilevel-systems-and-remediation/401-waterloo-multilevel-system/datasheet/permanent-waterloo-packers.php, retrieved Aug. 5, 2021.

(Continued)

*Primary Examiner* — Yong-Suk (Philip) Ro
(74) *Attorney, Agent, or Firm* — Leason Ellis LLP

(57) ABSTRACT

A system and method protect a packer during deployment in a borehole. The system comprises a shaft, the packer, a protective member, a movement mechanism, and an expansion mechanism. The shaft has a longitudinal length along a longitudinal axis extending in the borehole having an inner surface. The packer surrounds the shaft at a predetermined position along the longitudinal length. The protective member surrounds the shaft and is vertically positioned above or below the packer. The movement mechanism is configured to move the protective member to the predetermined position in order to surround the packer, thereby protecting the packer. The expansion mechanism is configured to expand the packer and the protective member when positioned around the packer to position the protective member in contact with the inner surface of the borehole. A method comprises steps performed during operation of the system.

20 Claims, 9 Drawing Sheets

(56) References Cited

U.S. PATENT DOCUMENTS

| | | | | |
|---|---|---|---|---|
| 8,857,526 | B2 | 10/2014 | Erkol et al. | |
| 8,960,313 | B2 | 2/2015 | Dyer et al. | |
| 11,313,201 | B1 * | 4/2022 | Harms | E21B 33/128 |
| 2014/0305627 | A1 * | 10/2014 | Man | E21B 33/1208 166/118 |
| 2015/0308214 | A1 * | 10/2015 | Bilansky | E21B 33/1208 166/387 |
| 2017/0145778 | A1 * | 5/2017 | Zijsling | E21B 43/103 |
| 2017/0370174 | A1 * | 12/2017 | Yun | E21B 33/1208 |
| 2022/0106852 | A1 * | 4/2022 | Schneider | E21B 17/1085 |

OTHER PUBLICATIONS

Superior Energy Services, Completion Tools Catalog, https://superiorenergy.com/_lit/b/scs/completion-tools-catalog.pdf, retrieved Aug. 5, 2021.

* cited by examiner

SYSTEM AND METHOD FOR PROTECTING A PACKER DURING DEPLOYMENT

FIELD OF THE DISCLOSURE

The present disclosure relates generally to packers in boreholes, and, more particularly, to a system and method for protecting a packer during deployment in a borehole.

BACKGROUND OF THE DISCLOSURE

Packers positioned in boreholes of wells have a risk of being damaged when deployed and when contacting the inner surface of the borehole. Damaged packers lack structural integrity as oil or gas is pumped in the well. Accordingly, such damaged packers must be replaced, which involves significant cost in the replacement of the packer itself as well as the cost of the downtime of operation of the well.

SUMMARY OF THE DISCLOSURE

According to an embodiment consistent with the present disclosure, a system and method protect a packer during deployment in a borehole.

In an embodiment, a system comprises a shaft, a packer, a protective member, a movement mechanism, and an expansion mechanism. The shaft has a longitudinal length along a longitudinal axis extending in a borehole having an inner surface. The packer surrounds the shaft at a predetermined position along the longitudinal length. The protective member surrounds the shaft and is vertically positioned above or below the packer. The movement mechanism is configured to move the protective member to the predetermined position in order to surround the packer, thereby protecting the packer. The expansion mechanism is configured to expand the packer and the protective member when positioned around the packer to position the protective member in contact with the inner surface of the borehole.

The protective member can be a substantially cylindrical sleeve. Alternatively, the protective member is composed of an absorbent material, such as a sponge. The expansion mechanism includes a liquid pump configured to apply a liquid to the absorbent material, thereby to expand the absorbent material. The movement mechanism includes a motor configured to move the protective member to the predetermined position.

In another embodiment, a system comprises a packer, a protective member, a movement mechanism, and an expansion mechanism. The packer surrounds a shaft having a longitudinal length along a longitudinal axis extending in a borehole, with the borehole having an inner surface, and with the packer disposed at a predetermined position along the longitudinal length. The protective member surrounds the shaft and is positioned at a distance from the packer. The movement mechanism is configured to move the protective member to the predetermined position in order to surround the packer, thereby protecting the packer. The expansion mechanism is configured to expand the packer and the protective member when positioned around the packer to position the protective member in contact with the inner surface of the borehole.

The protective member can be a substantially cylindrical sleeve. Alternatively, the protective member is composed of an absorbent material, such as a sponge. The expansion mechanism includes a liquid pump configured to apply a liquid to the absorbent material, thereby to expand the absorbent material. The movement mechanism includes a motor configured to move the protective member to the predetermined position.

In any of the embodiments, a suitable movement mechanisms include mechanical and hydraulic mechanisms as described herein, a CAM arrangement to partially open or fully open ports to control the area, or ports that enable pressure through the chamber to release the sleeve upward.

In a further embodiment, a method comprises positioning a packer at a predetermined position along a longitudinal length of a shaft having a longitudinal length along a longitudinal axis extending downward in a borehole with the borehole having an inner surface, and with the packer surrounding the shaft, positioning a protective member at a distance from the packer with the protective member surrounding the shaft, moving the protective member to the predetermined position in order to surround the packer thereby protecting the packer, and expanding the packer and the protective member when positioned around the packer to position the protective member in contact with the inner surface of the borehole. The protective member can be a substantially cylindrical sleeve. Alternatively, the protective member is composed of an absorbent material, and expanding the protective member includes applying a liquid to the absorbent material.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

It is noted that the drawings are illustrative and are not necessarily to scale.

DETAILED DESCRIPTION OF CERTAIN EMBODIMENTS OF THE DISCLOSURE

Example embodiments consistent with the teachings included in the present disclosure are directed to a system and method for protecting a packer using a sleeve or an absorbent material during deployment in a borehole.

Figure 1:
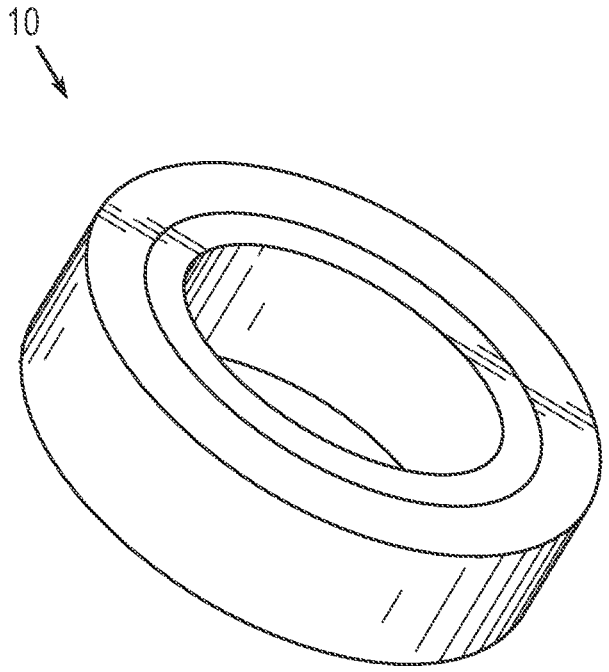
FIG. 1 illustrates a top side perspective view of a ring-shaped sleeve, according to an embodiment.
Figure 2:
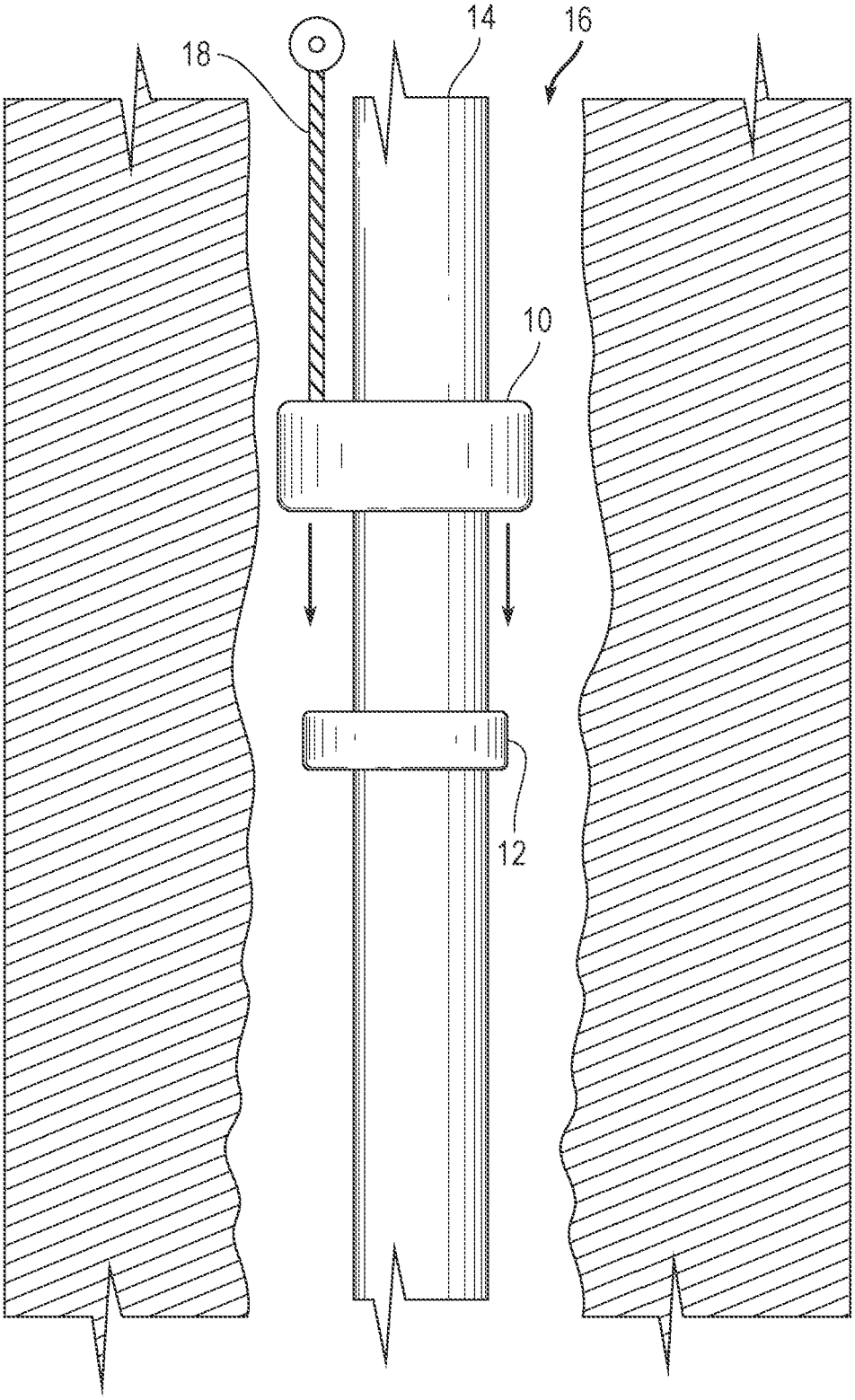
FIG. 2 illustrates a side view of a shaft in a borehole with a sleeve and a packer.
Figure 3:
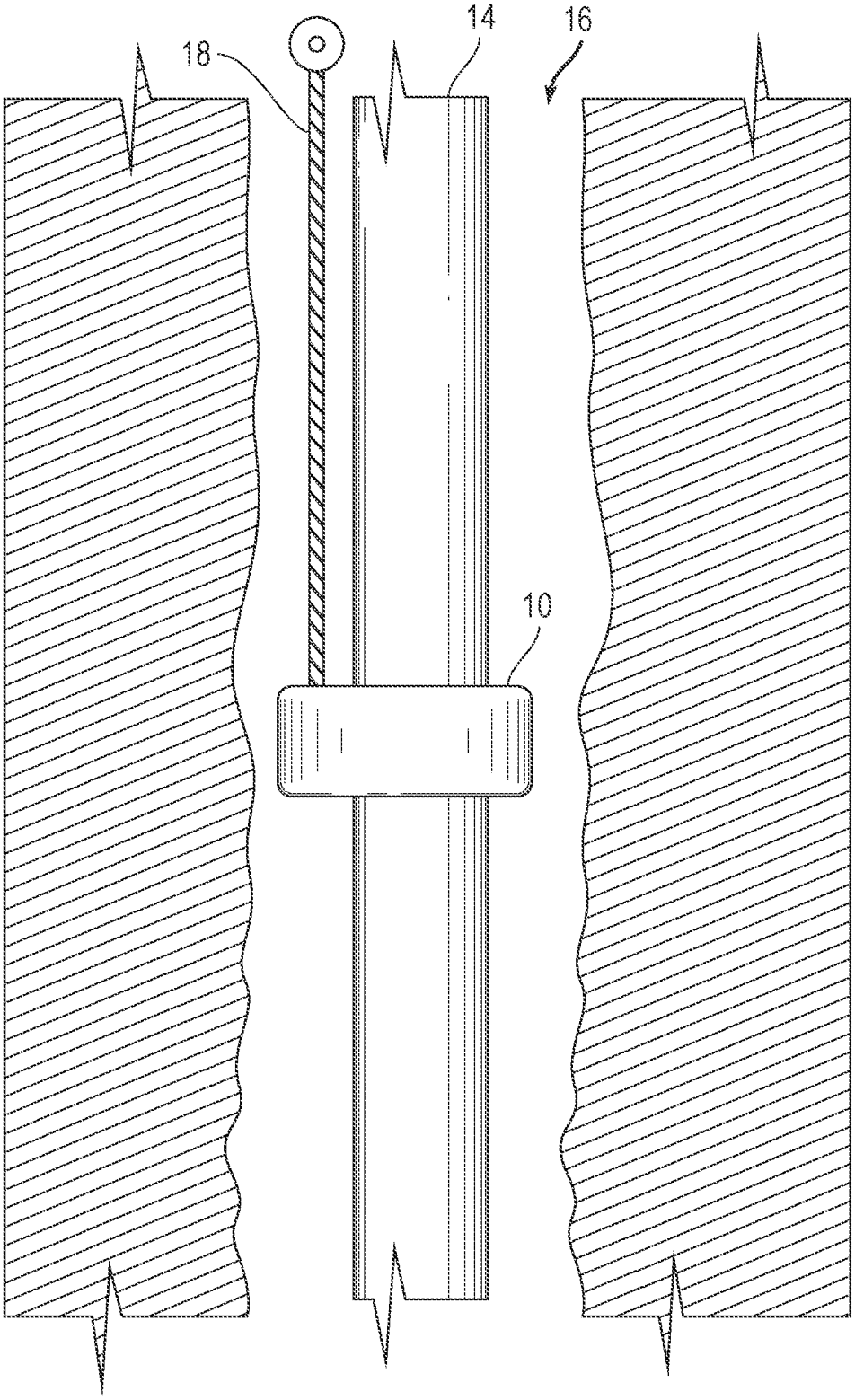
FIG. 3 illustrates a side view of the sleeve surrounding the packer.

As shown in FIGS. 1-2, the sleeve 10 is generally cylindrical or ring-like with a hollow central region through which a shaft 14 passes. The packer 12 surrounds the shaft 14 having a longitudinal length along a longitudinal axis extending in the borehole 16. The borehole 16 has an inner surface, and the packer 12 is disposed at a predetermined position along the longitudinal length. The sleeve 10 surrounds the shaft 14 and is positioned at a distance from the packer 12. The sleeve 10 can be positioned vertically above or below the packer 12. A movement mechanism 18 is configured to move the sleeve 10 to the predetermined position, as shown in FIGS. 2-3, in order for the sleeve 10 to completely surround the packer 12, thereby protecting the packer 12, as shown in FIG. 3.

Figure 4:
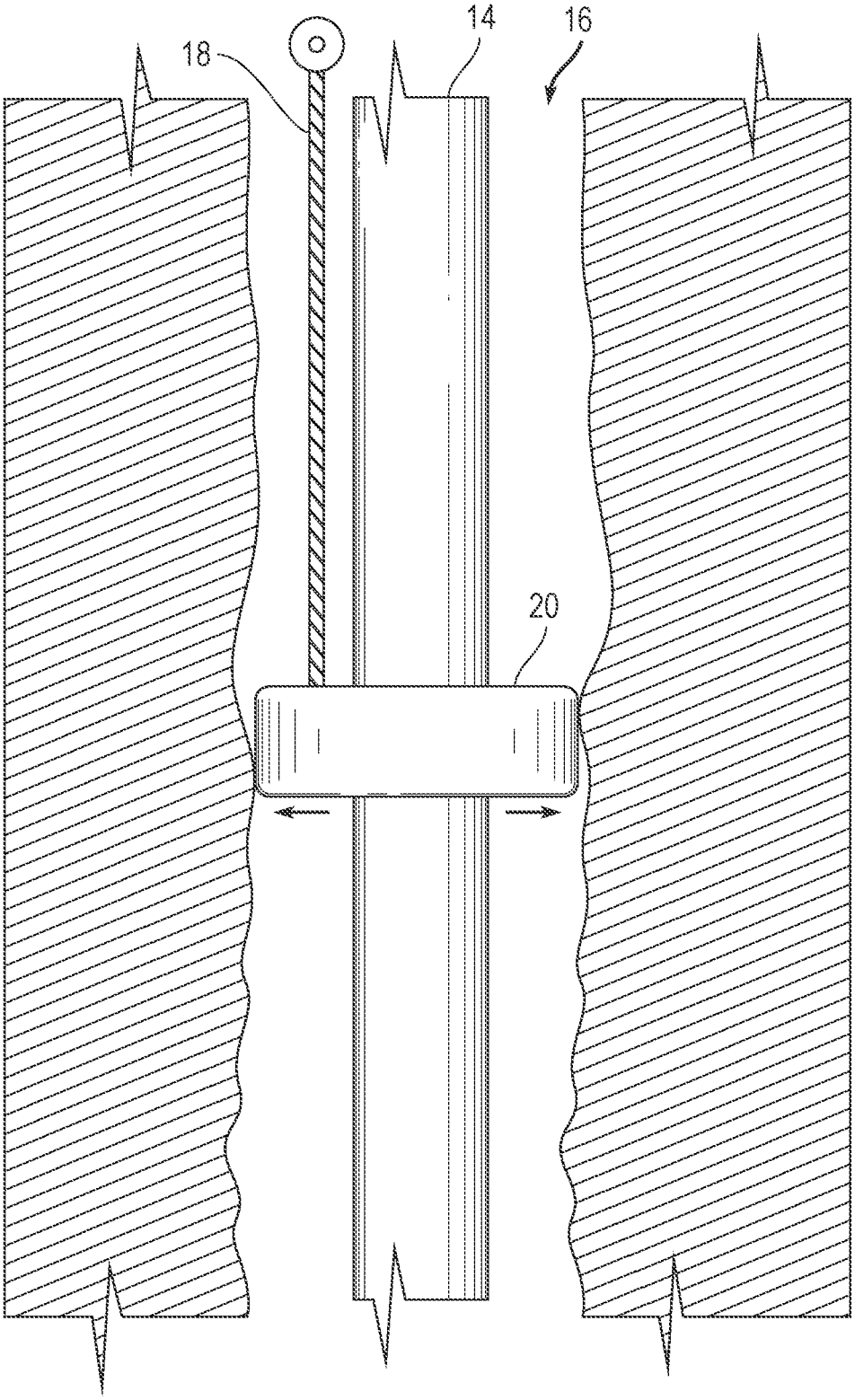
FIG. 4 illustrates a side view of the sleeve and the packer in an expanded state.

As shown in FIG. 4, an expansion mechanism is configured to expand the packer 12 and the sleeve 10 when positioned around the packer 12, to have an expanded configuration 20. Accordingly, an outer portion of the sleeve 10 is placed in contact with the inner surface of the borehole 16, so that the packer 12 itself does not contact the inner surface and risk damage. The movement mechanism 18 can include the expansion mechanism. The movement mechanism 18 can include a servomotor configured to move the sleeve 10 to the predetermined position. The movement mechanisms can comprise mechanical and hydraulic mechanisms as described herein, a CAM arrangement to partially open or fully open ports to control the area, or ports that enable pressure through the chamber to release the sleeve upward. The expansion mechanism can include a pump configured to pump a liquid or a gas into the packer 12 to expand the packer 12. The packer 12 can be a fillable bladder. The packer 12 can be composed of rubber. The sleeve 10 can be a stretchable material which stretches and expands as the packer 12 is expanded by the expansion mechanism during deployment of the packer 12 in the borehole 16.

Figure 5:
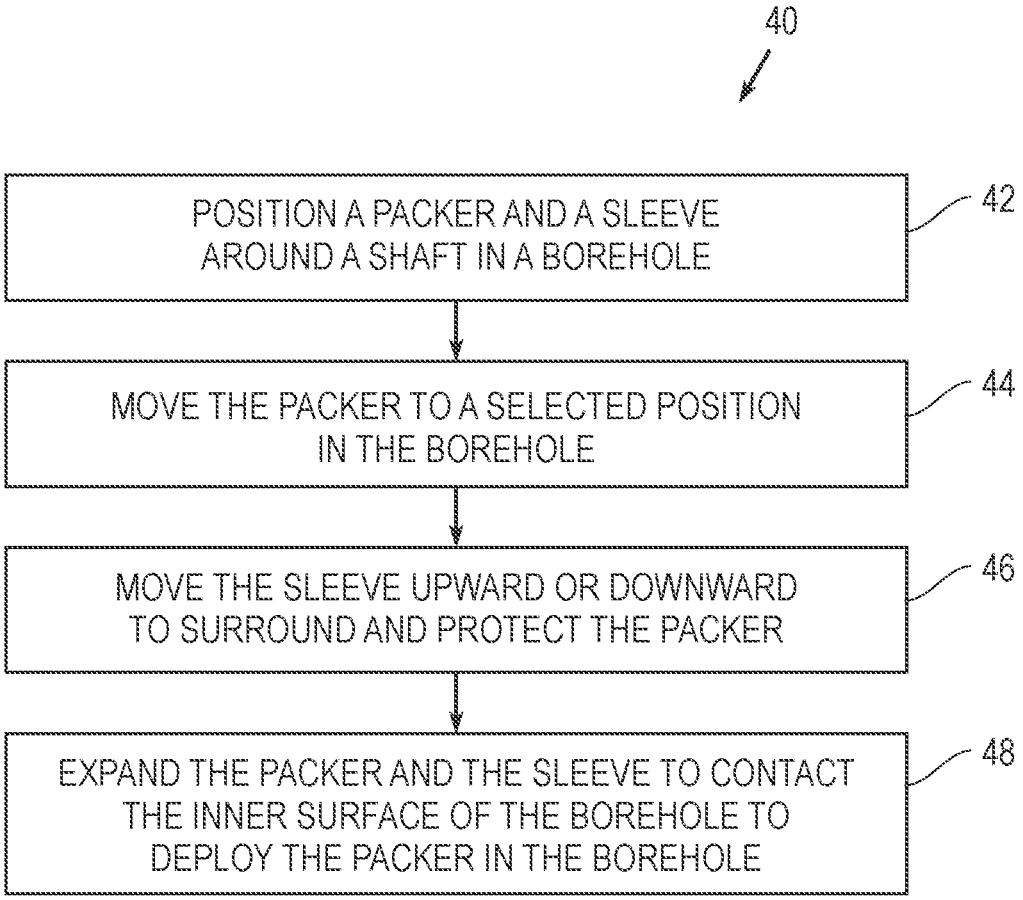
FIG. 5 illustrates a flowchart of deployment of the sleeve and the packer.

As shown in FIG. 5, a method 40 includes positioning the packer 12 and the sleeve 10 around the shaft 14 in the borehole 16 in step 42. The method 40 then moves the packer 12 to a selected position in the borehole 16 in step 44. The method 40 moves the sleeve 10 along the shaft 14, such as upwardly or downwardly, to surround and protect the packer 12 in step 46. The method 40 then expands the packer 12 and the sleeve 10 to contact the inner surface of the borehole 16 to deploy the packer 12 in the borehole 16 in step 48.

Figure 6:
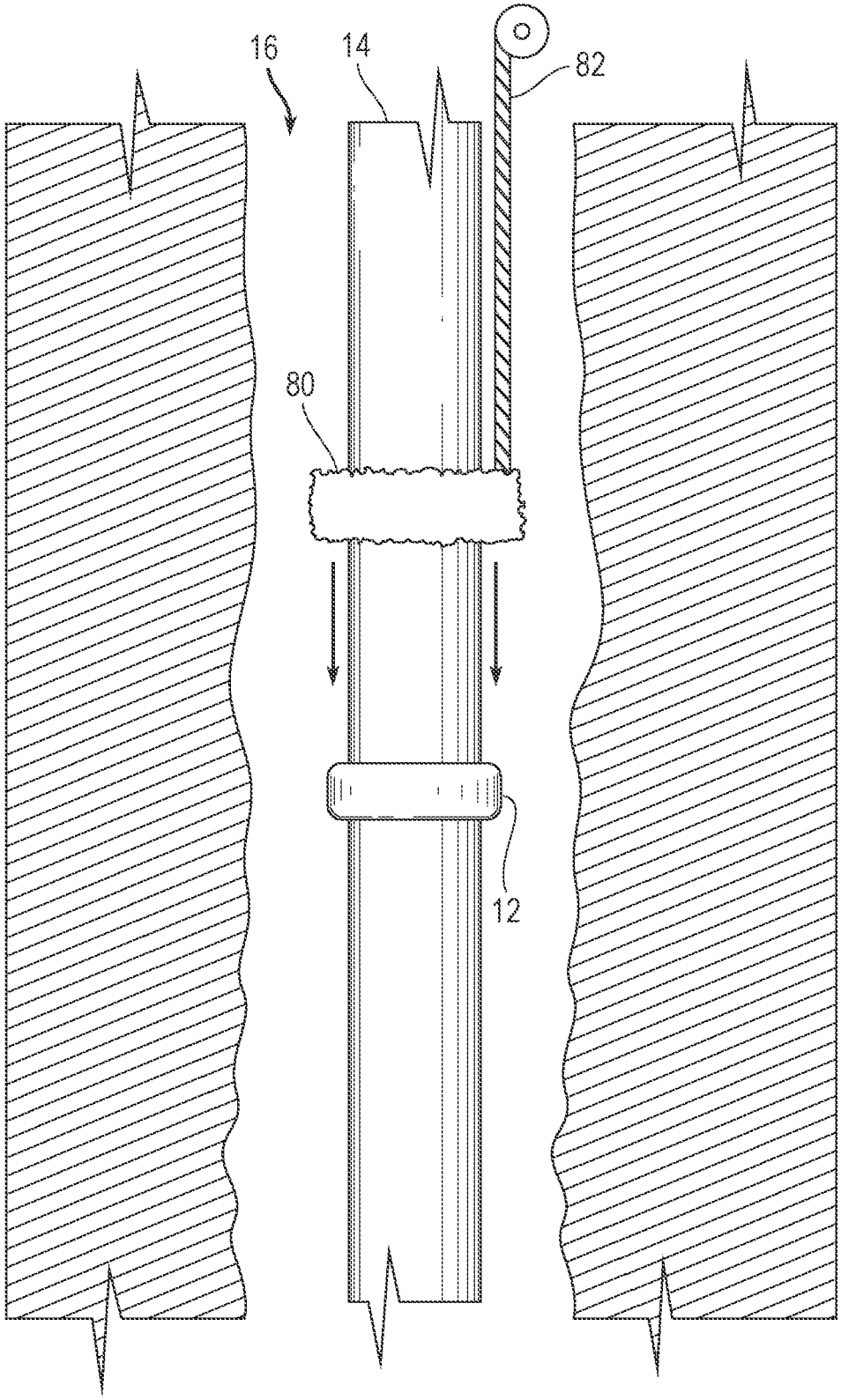
FIG. 6 illustrates a side view of a shaft in a borehole with a sponge and a packer.
Figure 7:
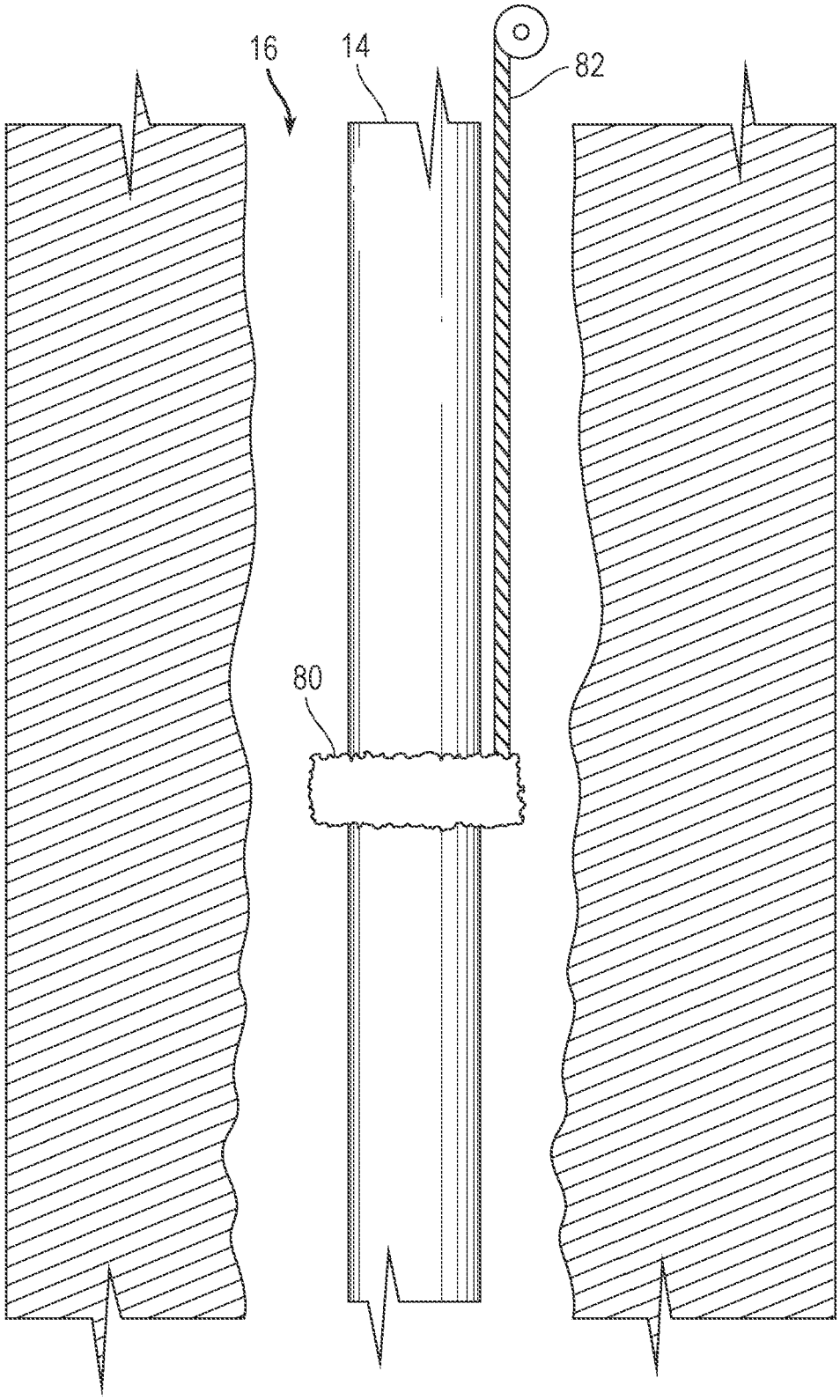
FIG. 7 illustrates a side view of the sponge surrounding the packer.

In an alternative embodiment, as shown in FIGS. 6-9, an absorbent material 80 surrounds the shaft 14. The absorbent material 80 can be a sponge. The absorbent material 80 can expand upon contact with a liquid or a gas. Referring to FIG. 6, the packer 12 surrounds the shaft 14 having a longitudinal length along a longitudinal axis extending in the borehole 16. The borehole 16 has an inner surface, and the packer 12 is disposed at a predetermined position along the longitudinal length. The absorbent material 80 surrounds the shaft 14 and is positioned at a distance from the packer 12. The absorbent material 80 can be positioned vertically above or below the packer 12. A movement mechanism 82 is configured to move the absorbent material 80 to the predetermined position, as shown in FIGS. 6-7, in order for the absorbent material 80 to completely surround the packer 12, thereby protecting the packer 12, as shown in FIG. 7.

Figure 8:
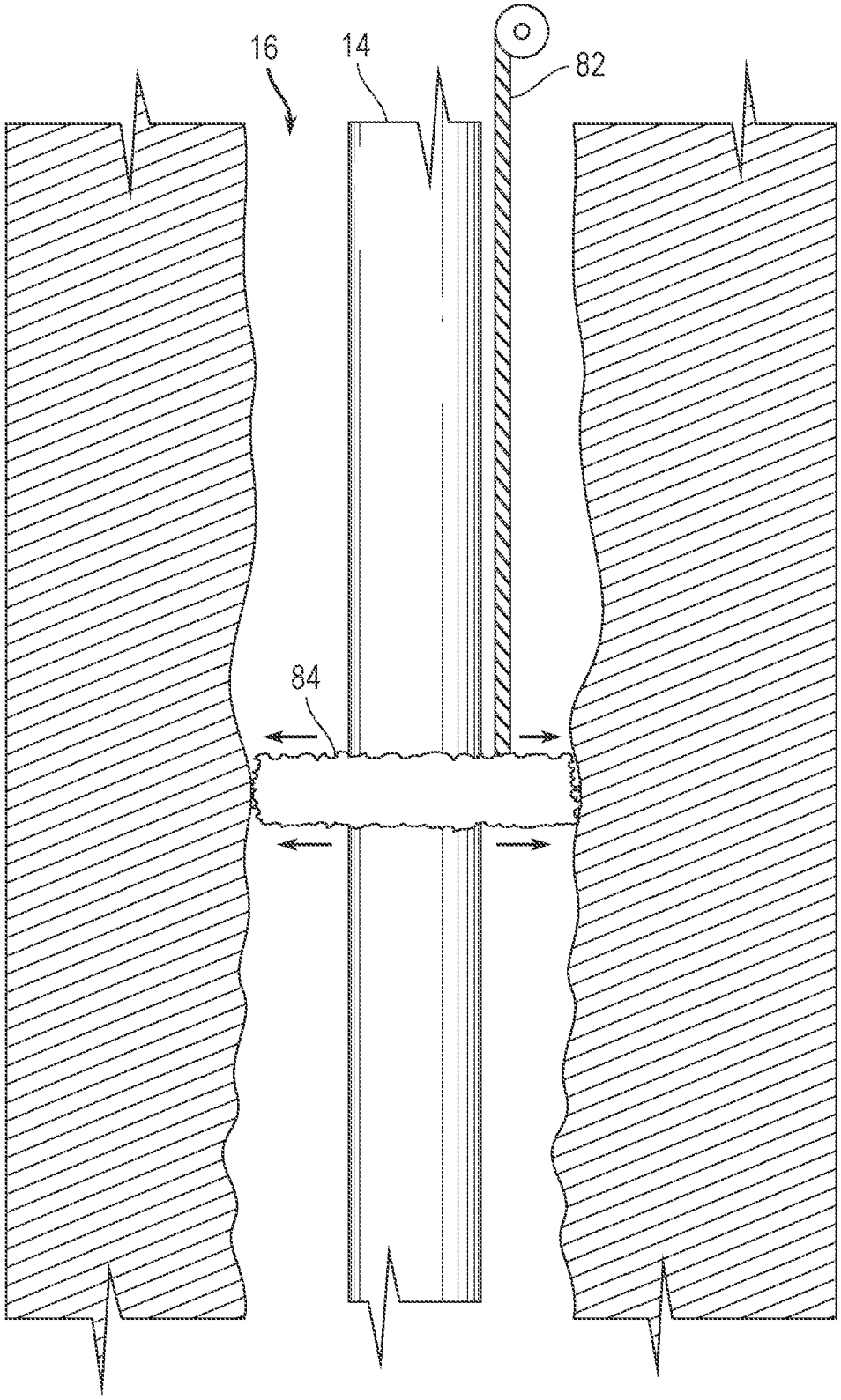
FIG. 8 illustrates a side view of the sponge and the packer in an expanded state.

As shown in FIG. 8, an expansion mechanism is configured to expand the packer 12 and the absorbent material 80 to have an expanded configuration 84. Accordingly, an outer portion of the absorbent material 80 is placed in contact with the inner surface of the borehole 16, so that the packer 12 itself does not contact the inner surface and risk damage. The movement mechanism 18 can include the expansion mechanism. The movement mechanism 18 can include a servomotor configured to move the absorbent material 80 to the predetermined position or the other arrangements described above. The expansion mechanism can include a pump configured to pump a liquid or a gas into the packer 12 to expand the packer 12. The packer 12 can be a fillable bladder. The packer 12 can be composed of rubber. The absorbent material 80 can be a stretchable material which stretches and expands as the packer 12 is expanded by the expansion mechanism during deployment of the packer 12 in the borehole 16. Alternatively, instead of the packer 12 expanding, the absorbent material 80 can be expanded by the expansion mechanism. The expansion mechanism can include a pump configured to pump a liquid or a gas into the absorbent material 80 to expand the absorbent material to contact the inner surface of the borehole 16, so that the packer 12 itself does not contact the inner surface and risk damage.

Figure 9:
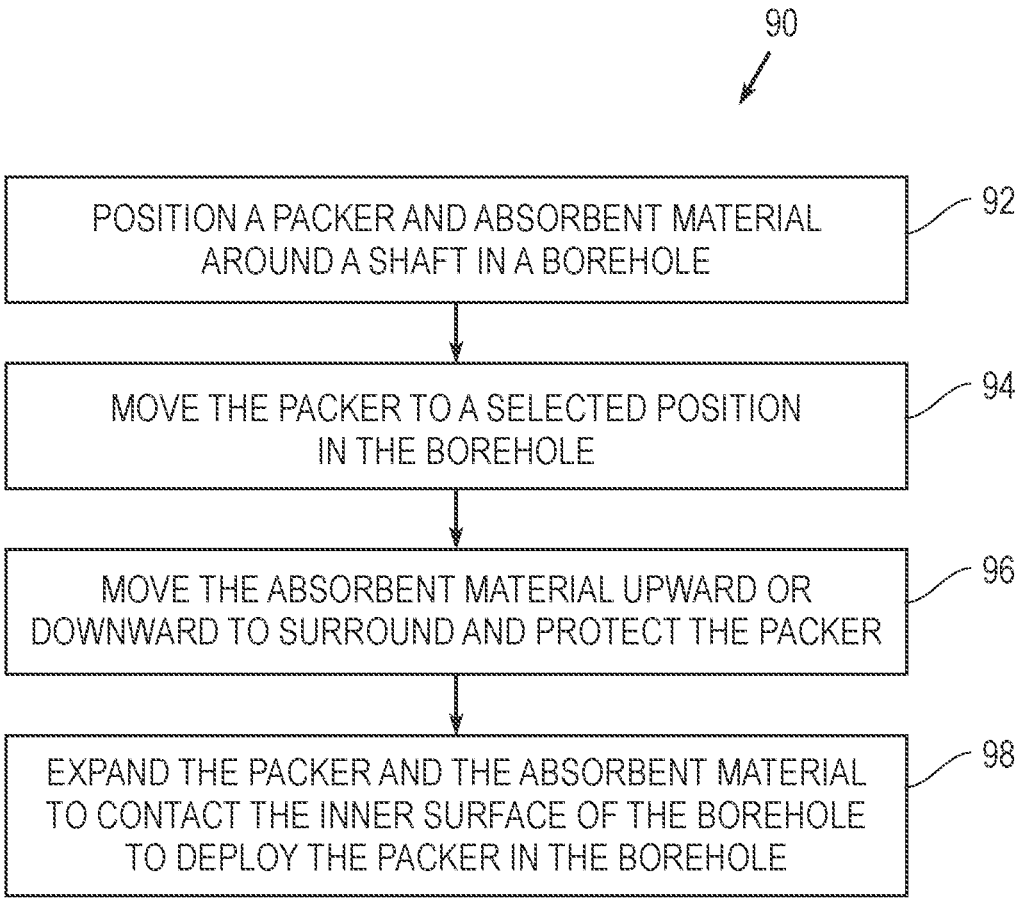
FIG. 9 illustrates a flowchart of deployment of the sponge and the packer.

As shown in FIG. 9, a method 90 includes positioning the packer 12 and the absorbent material 80 around the shaft 14 in the borehole 16 in step 92. The method 90 then moves the packer 12 to a selected position in the borehole 16 in step 94. The method 90 moves the absorbent material 80 along the shaft 14, such as upwardly or downwardly, to surround and protect the packer 12 in step 96. The method 90 then expands the packer 12 and the absorbent material 80 to contact the inner surface of the borehole 16 to deploy the packer 12 in the borehole 16 in step 98.

Portions of the methods described herein can be performed by software or firmware in machine readable form on a tangible (e.g., non-transitory) storage medium. For example, the software or firmware can be in the form of a computer program including computer program code adapted to cause the system to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A system, comprising:

a shaft having a longitudinal length along a longitudinal axis extending in a borehole having an inner surface;

a packer surrounding the shaft at a predetermined position along the longitudinal length;

a protective member surrounding the shaft and vertically positioned above or below the packer;

a movement mechanism configured to move the protective member to the predetermined position in order to surround the packer, thereby protecting the packer; and an expansion mechanism configured to expand the protected packer and the protective member to position the protective member in contact with the inner surface of the borehole.

2. The system of claim 1, wherein the protective member is a sleeve.

3. The system of claim 2, wherein the sleeve is substantially cylindrical.

4. The system of claim 2, wherein the movement mechanism includes a motor configured to move the sleeve to the predetermined position.

5. The system of claim 1, wherein the protective member is composed of an absorbent material.

6. The system of claim 5, wherein the protective member is a sponge.

7. The system of claim 5, wherein the movement mechanism includes a motor configured to move the protective member to the predetermined position.

8. The system of claim 5, wherein the expansion mechanism includes a liquid pump configured to apply a liquid to the absorbent material, thereby to expand the absorbent material.

9. A system, comprising:

a packer surrounding a shaft having a longitudinal length along a longitudinal axis extending in a borehole, with the borehole having an inner surface, and with the packer disposed at a predetermined position along the longitudinal length;

a protective member surrounding the shaft and positioned at a distance from the packer;

a movement mechanism configured to move the protective member to the predetermined position in order to surround the packer, thereby protecting the packer; and an expansion mechanism configured to expand the protected packer and the protective member to position the protective member in contact with the inner surface of the borehole.

10. The system of claim 9, wherein the protective member is a sleeve.

11. The system of claim 10, wherein the sleeve is substantially cylindrical.

12. The system of claim 10, wherein the movement mechanism includes a motor configured to move the sleeve to the predetermined position.

13. The system of claim 9, wherein the protective member is composed of an absorbent material.

14. The system of claim 13, wherein the protective member is a sponge.

15. The system of claim 13, wherein the movement mechanism includes a motor configured to move the protective member to the predetermined position.

16. The system of claim 13, wherein the expansion mechanism includes a liquid pump configured to apply a liquid to the absorbent material, thereby to expand the absorbent material.

17. A method, comprising:

positioning a packer at a predetermined position along a longitudinal length of a shaft having a longitudinal length along a longitudinal axis extending downward in a borehole, with the borehole having an inner surface, and with the packer surrounding the shaft;

positioning a protective member at a distance from the packer, with the protective member surrounding the shaft;

moving the protective member to the predetermined position in order to surround the packer, thereby protecting the packer; and expanding the protected packer and the protective member to position the protective member in contact with the inner surface of the borehole.

18. The system of claim 17, wherein the protective member is a substantially cylindrical sleeve.

19. The method of claim 17, wherein the protective member is composed of an absorbent material.

20. The method of claim 19, wherein expanding the protective member includes applying a liquid to the absorbent material.

* * * * *